US007276653B2

(12) United States Patent
Shimada

(10) Patent No.: US 7,276,653 B2
(45) Date of Patent: Oct. 2, 2007

(54) MARCHING BASS DRUM SUPPORTING STRUCTURE, MARCHING BASS DRUM, AND CARRIER

(75) Inventor: Masahiro Shimada, Seto (JP)

(73) Assignee: Hoshino Gakki Mfg. Co., Ltd. (JP)

( * ) Notice: Subject to any disclaimer, the term of this patent is extended or adjusted under 35 U.S.C. 154(b) by 238 days.

(21) Appl. No.: 11/091,995

(22) Filed: Mar. 29, 2005

(65) Prior Publication Data

US 2006/0081115 A1 Apr. 20, 2006

(30) Foreign Application Priority Data

Oct. 20, 2004 (JP) ..... 2004-305845
Feb. 24, 2005 (JP) ..... 2005-049438

(51) Int. Cl.
*G10D 13/02* (2006.01)

(52) U.S. Cl. ..... 84/421; 84/190; 84/327; 84/280; 84/379; 224/265

(58) Field of Classification Search ..... 84/190, 84/327, 421, 280, 379; 224/265
See application file for complete search history.

(56) References Cited

U.S. PATENT DOCUMENTS 2,588,830 A * 3/1952 Haanstad ..... 84/421
2,854,880 A * 10/1958 Waters ..... 84/421
3,021,744 A * 2/1962 Kester ..... 84/421
3,974,732 A * 8/1976 Kester, Jr. ..... 84/421
4,387,839 A * 6/1983 Dranchak ..... 224/265
D354,975 S * 1/1995 Penn ..... D17/22
5,573,158 A * 11/1996 Penn ..... 224/265
6,028,257 A * 2/2000 May ..... 84/421
6,323,407 B1 * 11/2001 May ..... 84/421
2006/0081114 A1 * 4/2006 Shimada ..... 84/421
2006/0081115 A1 * 4/2006 Shimada ..... 84/421
2006/0137506 A1 * 6/2006 May ..... 84/327

* cited by examiner

*Primary Examiner*—Lincoln Donovan
*Assistant Examiner*—Robert W. Horn
(74) *Attorney, Agent, or Firm*—Ostrolenk, Faber, Gerb & Soffen, LLP

(57) ABSTRACT

A carrier for holding a bass drum with two first connection mechanisms and one second connection mechanism. The second connection mechanism includes a connection member, which is arranged on the bass drum, and a slide member, which is arranged on the carrier. The distal end of the slide member is engaged with the connection member. Each first connection mechanism includes a hook receptacle, which is arranged on the bass drum and open in a downward direction, and a hook, which is arranged on the carrier and inserted in the receptacle.

11 Claims, 13 Drawing Sheets

MARCHING BASS DRUM SUPPORTING STRUCTURE, MARCHING BASS DRUM, AND CARRIER

BACKGROUND OF THE INVENTION

The present invention relates to a marching bass drum supporting structure, a marching bass drum, and a carrier.

In the prior art, a carrier (holder) used exclusively for a marching bass drum (hereafter simply referred to as a "bass drum") is known. One example of such a carrier is described in U.S. Pat. No. 6,323,407. The carrier enables the drummer to play the bass drum with its drum heads held in a vertical state. FIG. 14 is a perspective view showing a carrier 111 for a bass drum 110, as described in U.S. Pat. No. 6,323,407. In FIG. 14, the side of the drum farthest from the drummer when the drummer is wearing the carrier 111 is hereafter referred to as the "front" of the drum.

As shown in FIG. 14, the carrier 111 includes two reverse U-shaped straps 112, an abdomen contact plate 113, and an arm 114. The abdomen contact plate 113 comes into contact with the drummer's abdomen. The arm 114 links the straps 112 and the abdomen contact plate 113. A J-shaped hook 115 is arranged on the front end of each strap 112 near the portion connected to the arm 114. Each hook 115 is arranged so that its hooking portion is oriented upward and projected frontward. Two J-shaped rods 116 are fixed to the abdomen contact plate 113 by brackets 117. Each rod 116 is arranged so that its hooked portion is oriented frontward and projected upward.

The drummer wears the carrier 111 by placing the straps 112 over his or her shoulders so that the abdomen contact plate 113 contacts the abdomen of the drummer. The two hooks 115 of the carrier 111 are respectively engaged with two rings 118, which are arranged on the shell of the bass drum 110. Further, the distal ends of the rods 116 contact the shell of the bass drum 110 from underneath. In this way, the bass drum 110 is held by the carrier 111.

However, in the prior art structure described above, a clearance large enough to facilitate removal of the bass drum 110 from the carrier 111 is provided between the hooks 115 and the drum-side ring 118. Further, the weight of the bass drum 110 is supported by the rods 116 from underneath. Thus, when the drummer marches, the bass drum 110 vibrates. This produces noise from between the bass drum 110 and the rings 118 or from between the shell of the bass drum 110 and the rods 116.

Further, when an upward force is applied to the bass drum 110, such as when the drummer jumps, the bass drum 110 may easily be jolted upward. In such a case, the bass drum 110 may be separated from the rods 116.

Therefore, to prevent the bass drum 110 from being separated from the carrier 111 even if the bass drum 110 is jolted upward during performance, in the prior art structure, the rings 118 of the bass drum 110 cannot be disengaged from the hooks 115 unless the bass drum 110 is lifted until the bass drum 110 is located far from the rods 116 in the upward direction. However, this structure has a shortcoming in that the removal of the bass drum 110 from the carrier 111 is difficult.

Additionally, with the supporting structure of the carrier 111, the bass drum 110, which is hung on the two hooks 115, is supported by the two rods 116. Thus, if the two rods 116 are displaced, the bass drum 110 may be held in a state inclined to the drummer and result in the bass drum 110 being held unstably.

Accordingly, it is an object of the present invention to provide a marching bass drum carrier and a marching bass drum that prevent vibrations from moving a marching bass drum upward and away from the carrier, while stably holding the marching bass drum.

SUMMARY OF THE INVENTION

One aspect of the present invention is a supporting structure for supporting a marching bass drum with a carrier that is worn by a drummer in a state in which drum heads of the marching bass drum are held in a vertical state. The supporting structure is provided with a first connection mechanism, including a hooking portion arrangable on the carrier and a hooked portion arrangable on the marching bass drum, for movably connecting the marching bass drum to the carrier in a state in which the hooked portion is hooked to the hooking portion. A second connection mechanism connects the marching bass drum to the carrier to restrict movement of the marching bass drum relative to the carrier in a state in which the first connection mechanism movably connects the marching bass drum to the carrier.

Another aspect of the present invention is a marching bass drum for support by a drummer with a carrier that is worn by the drummer. The marching bass drum includes drum heads that are held in a vertical state when the carrier is worn by the drummer supporting the marching bass drum and a shell. A first connection mechanism, including a hooked portion arrangable on the marching bass drum, movably connects the marching bass drum to the carrier in a state in which the hooked portion is hooked to the carrier. A second connection mechanism connects the marching bass drum to the carrier to restrict movement of the marching bass drum relative to the carrier in a state in which the first connection mechanism movably connects the marching bass drum to the carrier. The second connection mechanism includes a connection member, having one end connected to a shell of the marching bass drum and another end connected to the carrier, for restricting movement of the marching bass drum relative to the carrier.

A further aspect of the present invention is a carrier for a drummer to wear for supporting a marching bass drum having drum heads that are held in a vertical state for use, a hooked portion, and a shell. The carrier is provided with a first connection mechanism, including a hooking portion, for movable connection to the marching bass drum in a state in which the hooking portion is hooked with the hooked portion of the marching bass drum. A second connection mechanism for connection to the marching bass drum to restrict movement of the marching bass drum in a state in which the first connection mechanism movably connects the marching bass drum. The second connection mechanism includes a connection member, having one end connectable to the shell of the marching bass drum for restricting movement of the marching bass drum. A slide member is arranged in a manner that its position is adjustable.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A marching bass drum according to a plurality of embodiments of the present invention will now be described in detail with reference to FIGS. 1 to 13.

First Embodiment

Figure 1:
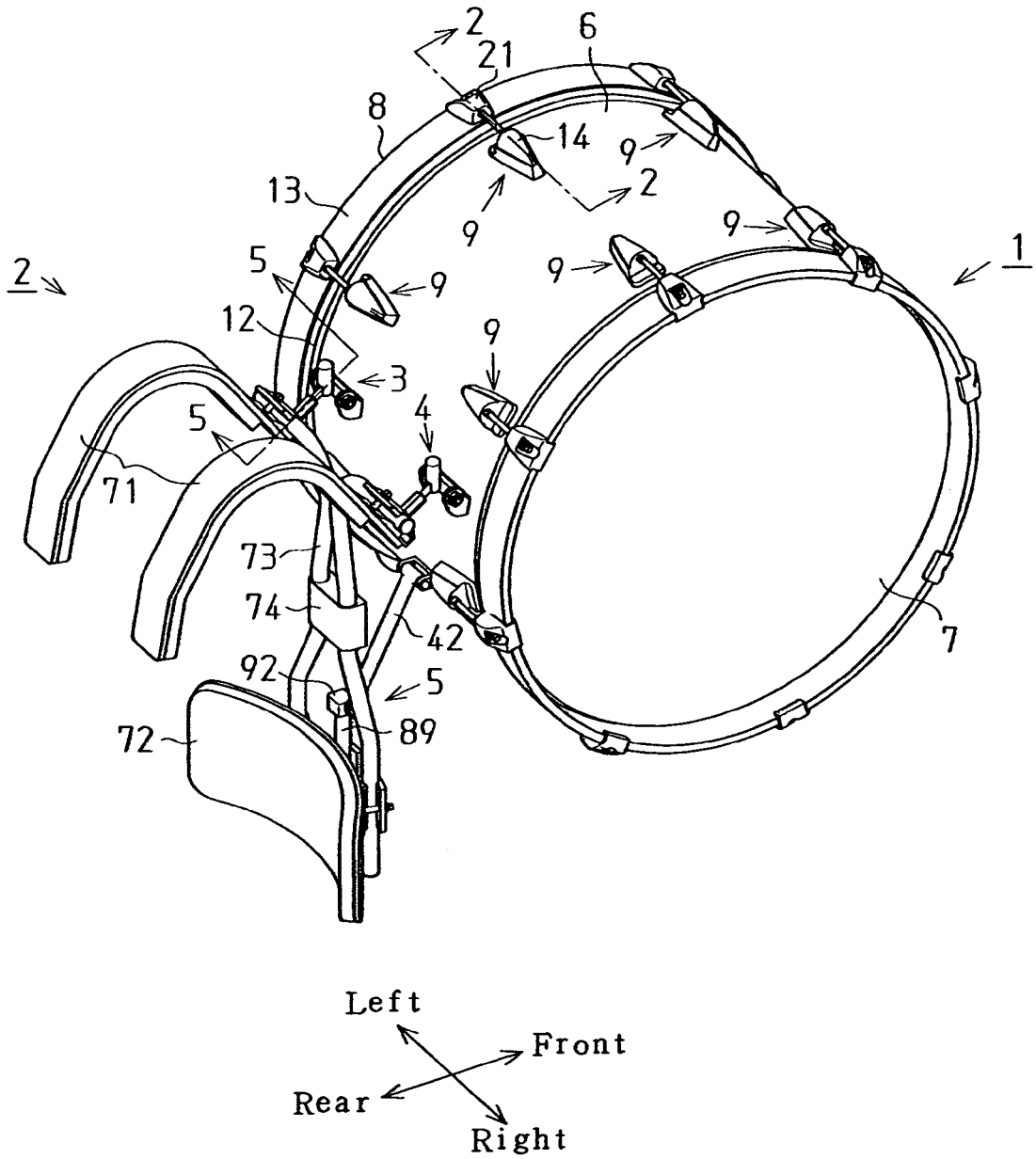
FIG. 1 is a perspective view showing a marching bass drum in a state mounted on a carrier according to a first embodiment of the present invention.
Figure 8:
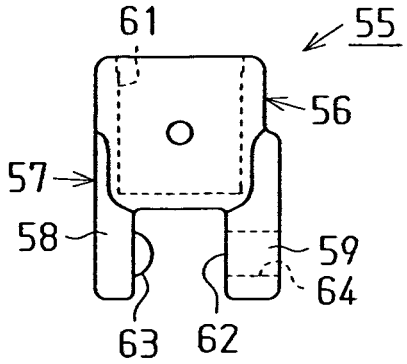
FIG. 8(*a*) is a front view showing a drum-side connection member, FIG. 8(*b*) is a plan view showing the drum-side connection member, FIG. 8(*c*) is a left side view showing the drum-side connection member, FIG. 8(*d*) is a right side view showing the drum-side connection member, and FIG. 8(*e*) is a cross-sectional view taken along line 8*e*-8*e* in FIG. 8(*b*)
Figure 8:
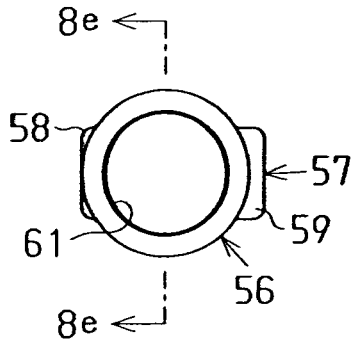
Figure 8:
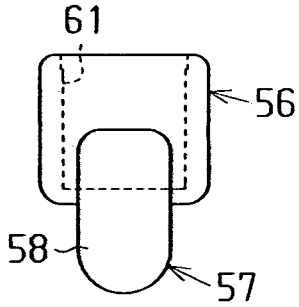
Figure 8:
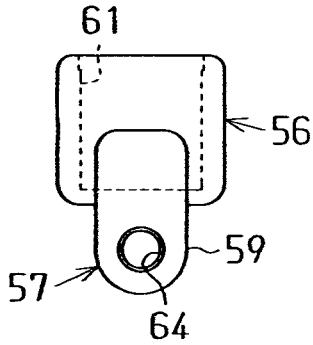
Figure 8:
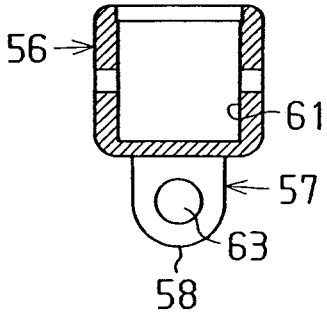
Figure 9:
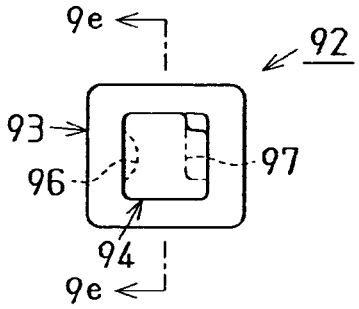
FIG. 9(*a*) is a front view showing a carrier-side engagement member, FIG. 9(*b*) is a plan view showing the carrier-side engagement member, FIG. 9(*c*) is a left side view showing the carrier-side engagement member, FIG. 9(*d*) is a right side view showing the carrier-side engagement member, FIG. 9(*e*) is a cross-sectional view taken along line 9*e*-9*e* in FIG. 9(*a*), and FIG. 9(*f*) is a cross-sectional view taken along line 9*f*-9*f* in FIG. 9(*c*)
Figure 9:
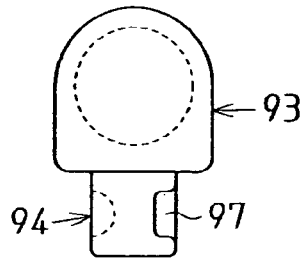
Figure 9:
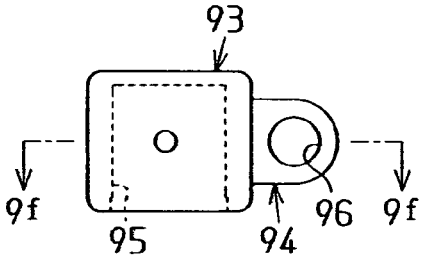
Figure 9:
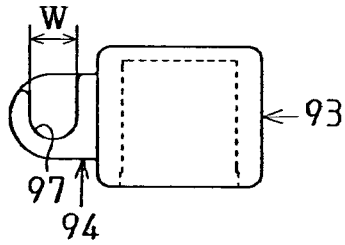
Figure 9:
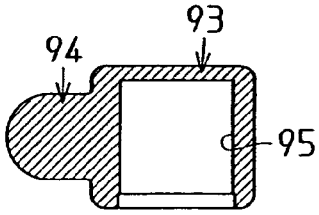
Figure 9:
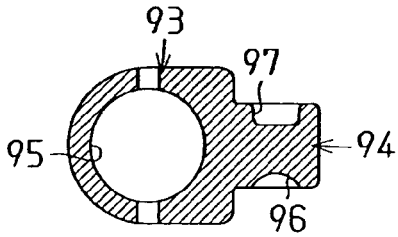
Figure 10:
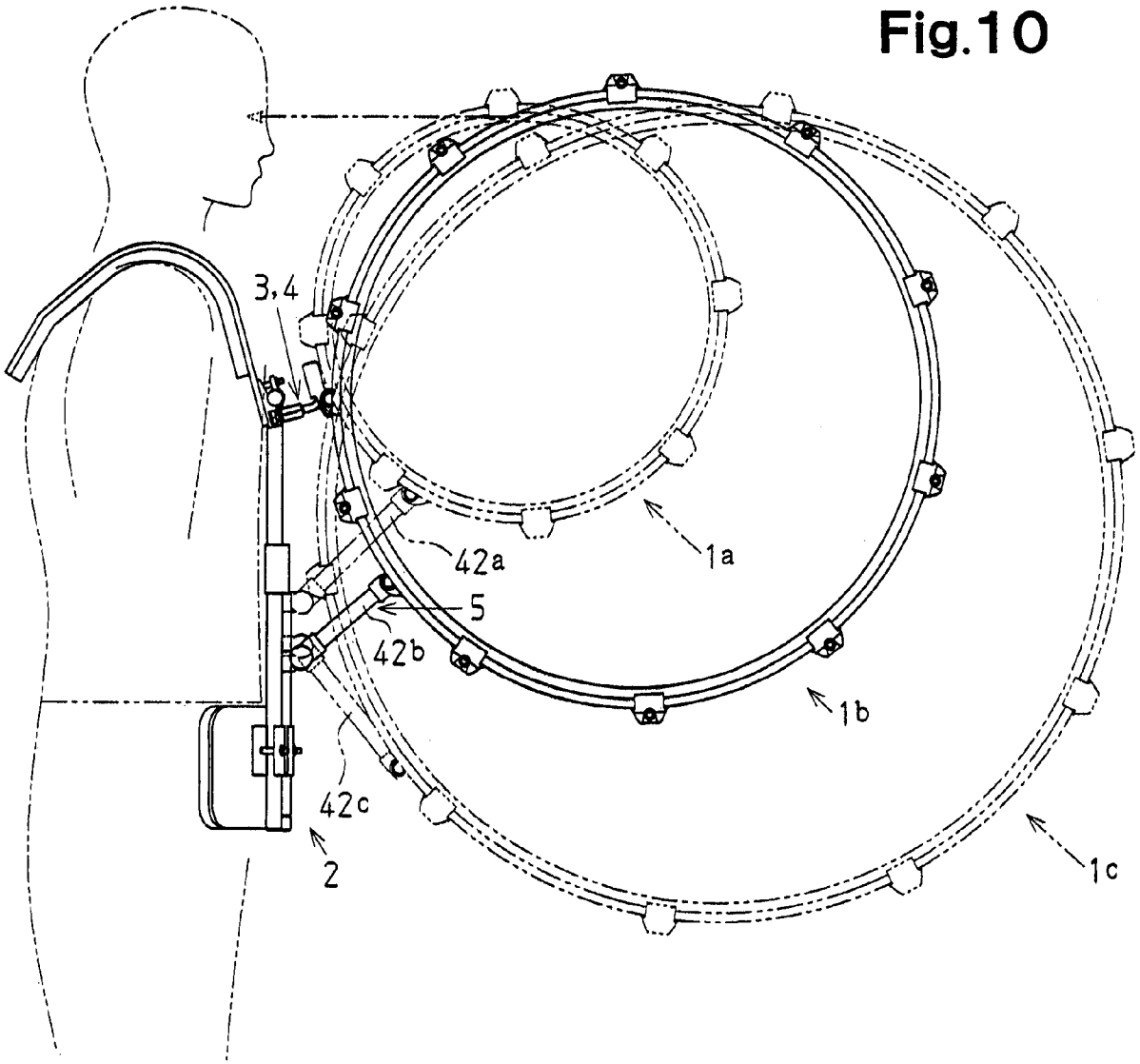
FIG. 10 is a side view showing the state in which the bass drum is used.

A first embodiment of the present invention will now be described with reference to FIGS. 1 to 10. FIG. 1 shows a marching bass drum (hereafter simply referred to as a "bass drum") 1 in a state mounted on a carrier 2. As shown in FIG. 1, the bass drum 1 is mounted on the carrier 2 by upper first connection mechanisms 3 and 4, which are arranged at two locations, and a lower second connection mechanism 5, which is arranged at one location. The side of the drum farthest from the drummer when the drummer is wearing the carrier 2 that holds the bass drum 1 (the bass drum 1 side in FIG. 1) is hereafter referred to as the "front" of the bass drum 1, and the right side of the drummer is hereafter referred to as the "right" side of the bass drum 1. In the present embodiment, as shown in FIG. 10, a plurality of bass drums 1 that differ in size (bass drums 1*a*, 1*b*, and 1*c*) can be selectively mounted on the carrier 2 by the first connection mechanisms 3 and 4 and the second connection mechanism 5.

[Marching Bass Drum 1]

As shown in FIG. 1, the bass drum 1 includes a cylindrical shell 6 with open right and left ends. The shell 6 is made of wood. A right head 7 and a left head 8, which are circular membranes, are arranged under tension on the shell 6 to close the right and left open ends of the shell 6, respectively. Each of the heads 7 and 8 forms a head surface that extends vertically. A plurality of (eight in the present embodiment) head adjustment units 9 for adjusting the tension of the heads 7 and 8 are arranged at equal angular intervals on the rims of the right and left open ends of the shell 6.

Figure 2:
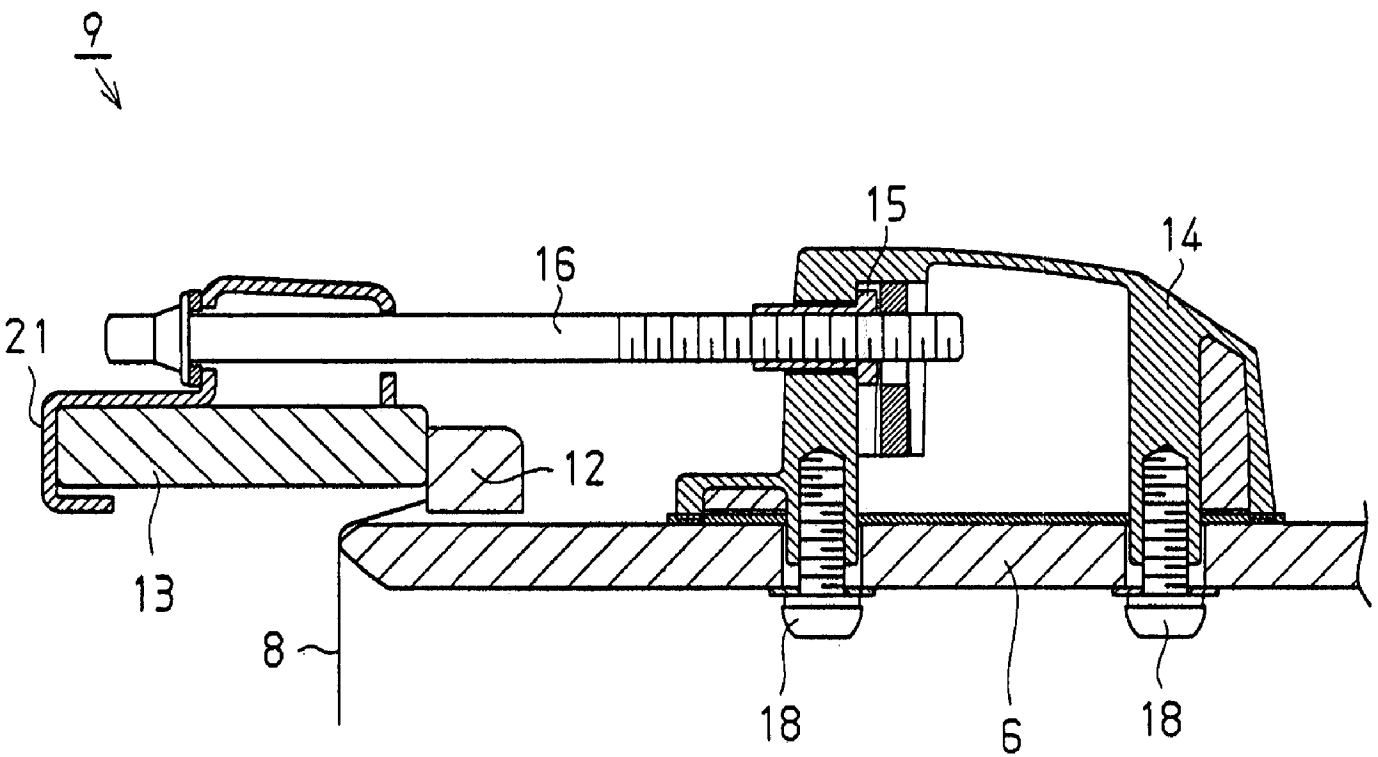
FIG. 2 is a partial cross-sectional view taken along line 2-2 in FIG. 1 and shows a head adjustment unit.

FIG. 2 shows one of the head adjustment units 9 arranged on the rim of the left end of the shell 6. As shown in FIG. 2, the rim of the left head 8 is held by an annular head frame 12. The head frame 12 is engaged with the rim of the left open end of the shell 6. In this way, the head 8 is arranged to cover the open end of the shell 6. An annular hoop 13, which presses the head frame 12 inward, is arranged on the outer side of the head frame 12. The hoop 13 is supported by the head adjustment units 9 and is spaced from the shell 6.

The head adjustment units 9 have the structure described below. Eight lugs 14 are arranged at equal angular intervals of 45 degrees on each rim of the right and left ends of the shell 6. Each lug 14 is hollow and fixed to the rim of the shell 6 by two screws 18 extending through the shell 6 from the inside of the shell 6. A lug nut 15 is attached to each lug 14 to project toward the head 7 or 8. A lug bolt 16 is fastened to each lug nut 15. The head of each lug bolt 16 is arranged at the outer side of the hoop 13 by a hoop engagement member 21. The lug bolt 16 connects the lug 14 to the hoop 13. By fastening the lug bolt 16 to the lug nut 15, the hoop engagement member 21 presses the hoop 13, and the hoop 13 presses the head frame 12 toward the lug 14. The head 8 is pressed against the rim of the open end of the shell 6 to increase tension. This adjusts the tune of the bass drum 1 to a high pitch.

Figure 4:
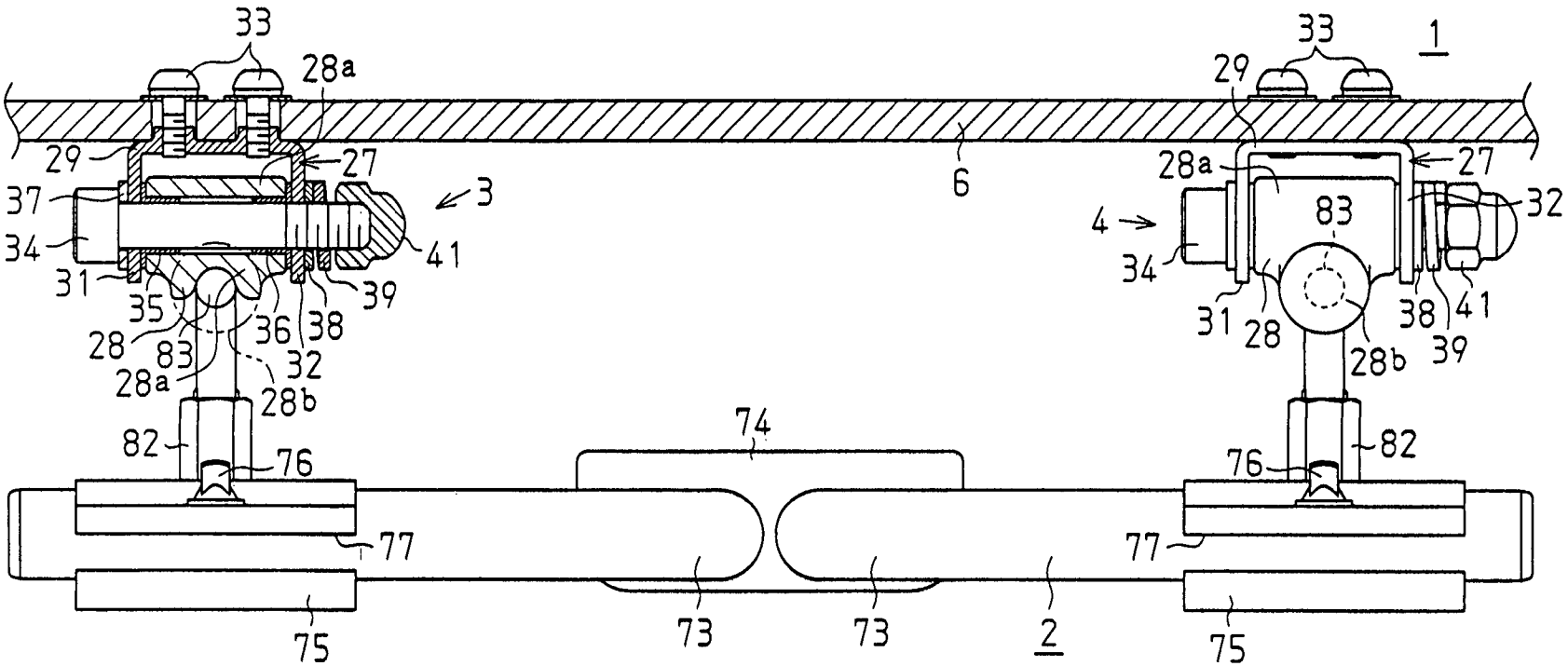
FIG. 4 is a partial cross-sectional view of a first connection mechanism.
Figure 5:
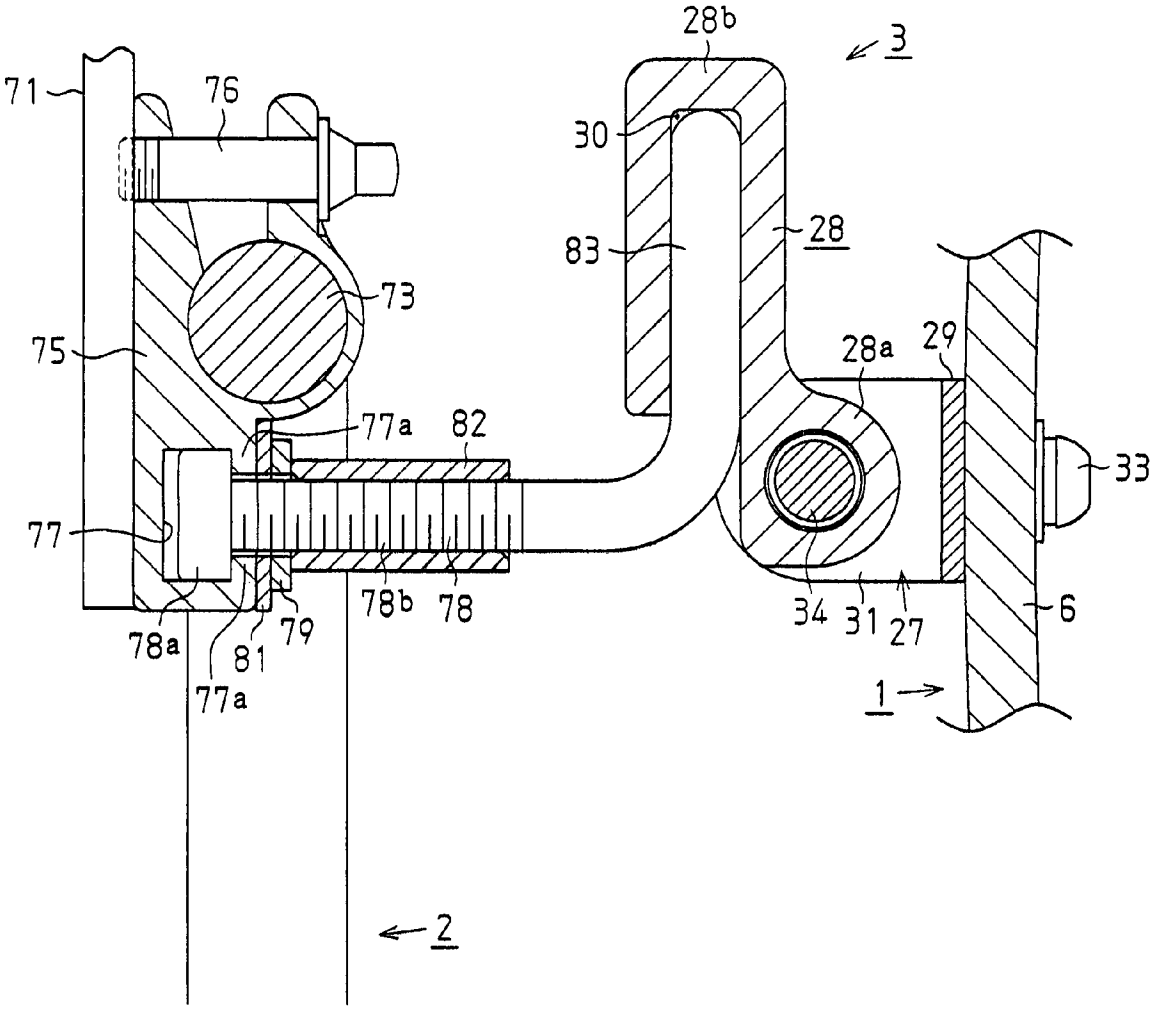
FIG. 5 is a cross-sectional view taken along line 5-5 in FIG. 1 and shows the structure of the first connection mechanism and a connection bracket.

FIG. 4 is a partially cutaway plan view of the first connection mechanisms 3 and 4. FIG. 5 is a cross section view taken along line 5-5 in FIG. 1. Each of the first connection mechanisms 3 and 4 includes members of the bass drum 1 and members of the carrier 2. A receptacle portion 28*b* arranged on the bass drum 1 in each of the first connection mechanisms 3 and 4 will first be described with reference to FIGS. 4 and 5.

Each of the first connection mechanisms 3 and 4 includes a fixed plate 27 and a hook receptacle 28 (hooked portion). The fixed plate 27 is fixed to the bass drum 1. The hook receptacle 28 is arranged on the fixed plate 27 and hooked on a hook 83 (hooking portion), which is arranged on the carrier 2. The fixed plate 27 is formed by a metal plate. The fixed plate 27 includes a rectangular base portion 29 and two side portions 31 and 32 facing each other. The side portions 31 and 32 are formed by bending the metal plate rearward at the left and right ends of the base portion 29. The base portion 29 is in contact with the shell 6 and fixed to the shell 6 by two screws 33 from the inside of the shell 6. A bolt 34, which extends parallel to the axis of the bass drum 1, is attached to the side portions 31 and 32.

The hook receptacle 28 includes a cylindrical pivot portion 28*a* and the receptacle portion 28*b*, which is cylindrical. The pivot portion 28*a* is arranged between the two side portions 31 and 32. The bolt 34 is inserted through the pivot portion 28*a*. The receptacle portion 28*b* has a closed top end and a bore 30 that opens downward. A pair of bushings 35 and 36 are arranged between the pivot portion 28*a* and the bolt 34. Each of the bushings 35 and 36 is made of, for example, a polyamide resin. Each of the bushings 35 and 36 includes a cylindrical main body and a flange formed on the rim of one end of the main body. The cylindrical main body is arranged between the pivot portion 28*a* and the bolt 34. The flange is arranged between the pivot portion 28*a* and the side portions 31 and 32. The bushings 35 and 36 absorb impacts applied to the bolt 34 to prevent noise from being generated and to provide the bolt 34 and the hook receptacle 28 with suitable friction resistance. The bolt 34 is inserted from the left side portion 31 to the right the side portion 32 via a washer 37. The bolt 34 is fixed to the fixed plate 27 by a nut 41 via a washer 38 and a spring washer 39. The fastening of the bolt 34 and the nut 41 results in the side portions 31 and 32 of the fixed plate 27 clamping the pivot portion 28*a* of the hook receptacle 28 from the left and right sides via the bushings 35 and 36.

The receptacle portion 28*b* of the hook receptacle 28 is arranged in the generally middle part of the pivot portion 28*a*. The receptacle portion 28*b* is formed integrally with the pivot portion 28*a*. The receptacle portion 28*b* pivots integrally with the pivot portion 28*a*. The receptacle portion 28*b* may be fixed at any position. For example, the receptacle portion 28*b* may be fixed so that the bore 30 extends downward. More specifically, the side portions 31 and 32 are pressed against the pivot portion 28*a* via the bushings 35 and 36 in accordance with the fastened amount of the bolt 34 and the nut 41. A suitable resistance is applied to the side portions 31 and 32 and the bushings 35 and 36 to determine the pivotal movement of the pivot portion 28*a*. Thus, the receptacle portion 28*b* may be fixed at any angular position and be held at the fixed position. Further, the angle of the receptacle portion 28*b* is easily adjusted. As shown in FIG. 5, when the bass drum 1 is mounted on the carrier 2, the hook 83 arranged on the carrier 2 is inserted into the bore 30 of the receptacle portion 28*b* of the hook receptacle 28 so that the hook receptacle 28 is engaged with the hook 83. In this way, the bass drum 1 is held by the carrier 2 in a manner that the bass drum 1 is pivotally movable around the axis of the bolt 34.

Figure 6:
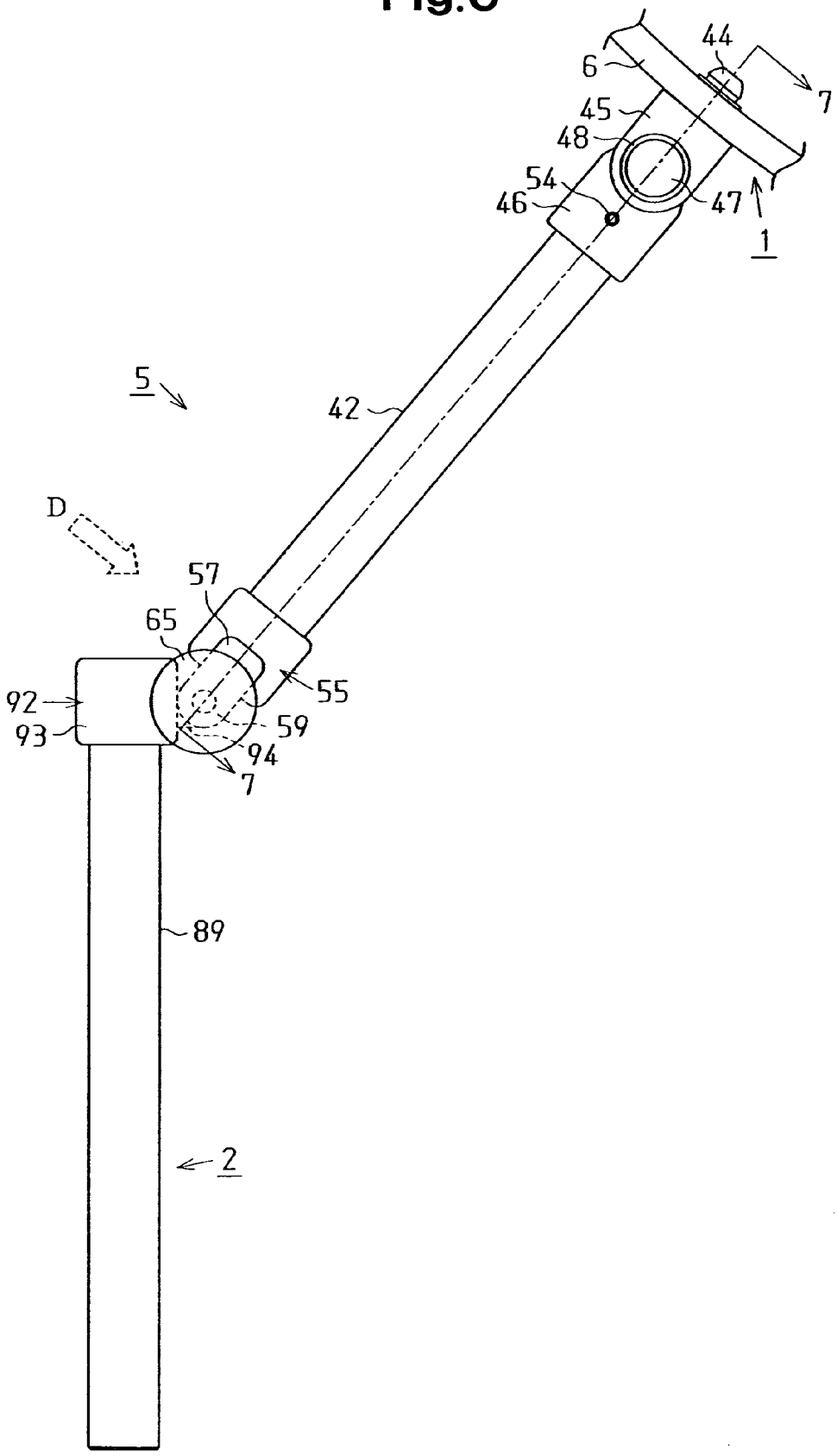
FIG. 6 is a side cross-sectional view of a second connection mechanism.
Figure 7:
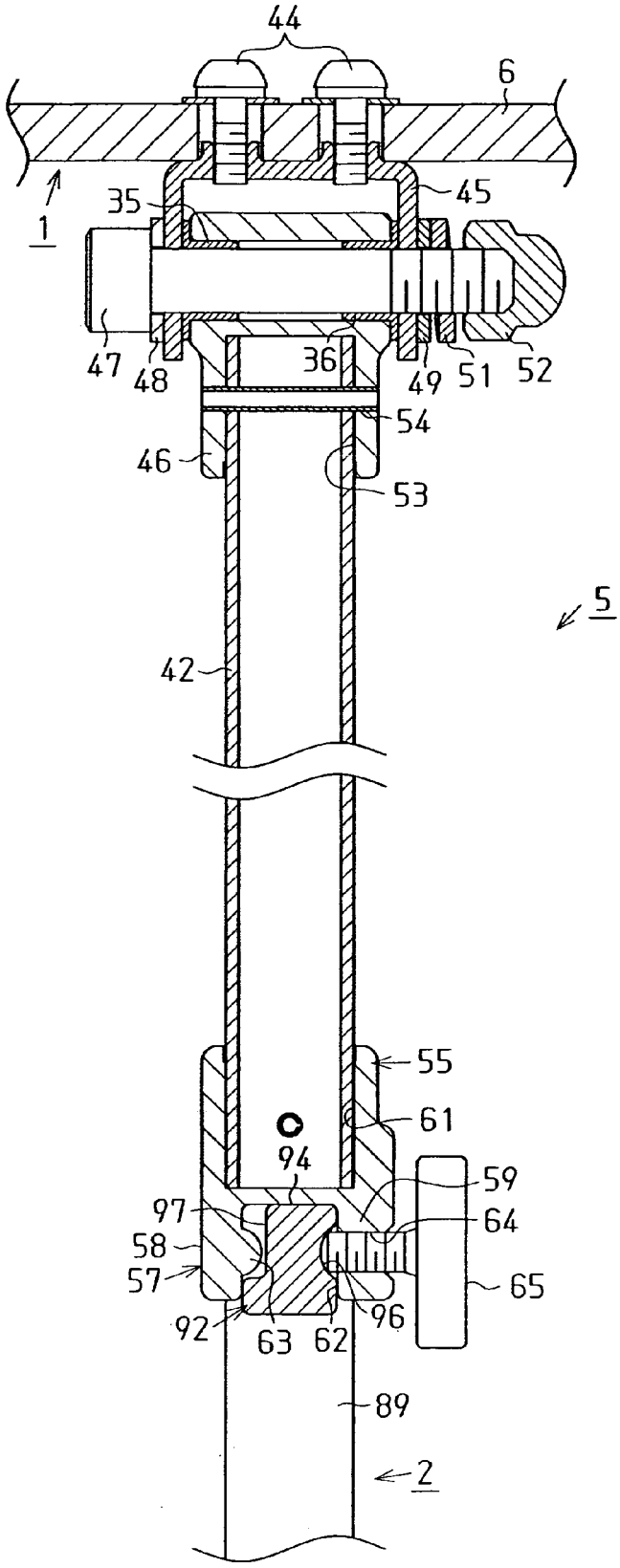
FIG. 7 is a cross-sectional view taken along line 7-7 in FIG. 6 and shows the second connection mechanism.

The second connection mechanism 5 will now be described. As shown in FIG. 1, the second connection mechanism 5 is arranged below the first connection mechanisms 3 and 4 at a position between the first connection mechanisms 3 and 4. A connection member 42, which forms part of the second connection mechanism 5, is arranged on the bass drum 1. FIG. 6 is a right side view of the second connection mechanism 5. FIG. 7 is a cross-sectional view taken along line 7-7 in FIG. 6. The second connection mechanism 5 includes a structure for the bass drum 1 and a structure for the carrier 2. First, the structure of the second connection mechanism 5 for the bass drum 1 will be described with reference to FIGS. 6 and 7.

The second connection mechanism 5 includes a fixed plate 45, the connection member 42, and an upper connector 46. The fixed plate 45 is fixed to the bass drum 1. The connection member 42 is formed by a hollow pipe. The connector 46 connects the connection member 42 and the fixed plate 45 to each other. As shown in FIG. 1, the connection member 42 extends diagonally downward from the shell 6 of the bass drum 1 toward the lower portion of the carrier 2.

The mounting structure of screws 44, the fixed plate 45, a bolt 47, bushings 35 and 36, and the connector 46 is the same as the mounting structure described above for the first connection mechanisms 3 and 4. The second connection mechanism 5 differs from the first connection mechanisms 3 and 4 in that the hook receptacle 28 of the first connection mechanisms 3 and 4 is replaced by the connector 46.

More specifically, the connector 46 is attached to the bolt 47 by washers 48 and 49, a spring washer 51, and a nut 52. Thus, the connector 46 is pivotal relative to the bolt 47. A suitable resistance is applied to the connector 46 as it pivots. Thus, the connector 46 may be held at any angular position. Further, the connector 46 has a bore 53. The connection member 42 is inserted in the bore 53 and fixed to the connector 46 by a spring pin 54.

A drum-side engagement member 55 is attached to the distal end (bottom end) of the connection member 42. FIGS. 8(*a*) to 8(*e*) show the drum-side engagement member 55. FIG. 8(*a*) is a front view showing only the drum-side engagement member 55, as viewed from the direction of arrow D in FIG. 6. In the same manner, FIG. 8(*b*) is a plan view showing the drum-side engagement member 55, FIG. 8(*c*) is a left side view showing the drum-side engagement member 55, FIG. 8(*d*) is a right side view showing the drum-side engagement member 55, and FIG. 8(*e*) is a cross-sectional view taken along line 8*e*-8*e* in FIG. 8(*b*).

As shown in FIGS. 8(*a*), 8(*b*), and 8(*c*), the drum-side engagement member 55 includes a cylindrical joint portion 56 and a mating portion 57. The joint portion 56 has an insertion hole 61 that opens upward. The mating portion 57 is engaged with a carrier-side engagement member 92, as shown in FIG. 7. The connection member 42 is inserted into the insertion hole 61 of the joint portion 56.

The mating portion 57 includes a left projection 58 and a right projection 59 that project downward from the joint portion 56. The space surrounded between the inner surfaces of the left projection 58 and the right projection 59 and the bottom surface of the joint portion 56 forms an insertion portion 62. Further, a semispherical projection 63 is formed on the inner surface of the left projection 58. The right projection 59 has a threaded hole 64, which is formed to face the projection 63 of the left projection 58. As shown in FIG. 7, a bolt 65 is fastened to the threaded hole 64 from the outer side.

[Carrier 2]

Figure 3:
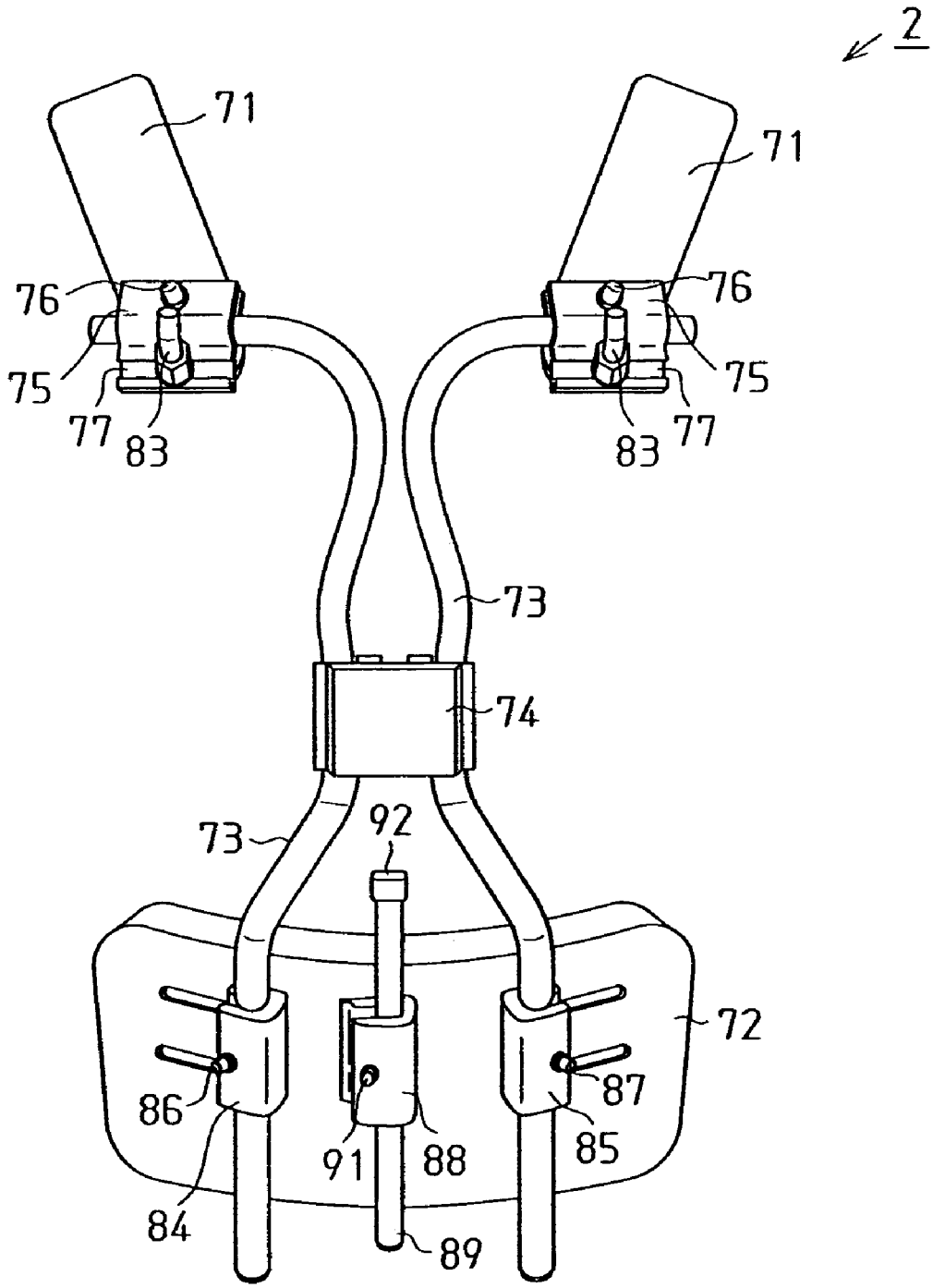
FIG. 3 is a rear view showing the carrier.

The structure of the carrier 2 will now be described. FIG. 3 shows the carrier 2 as viewed from the front. As shown in FIGS. 1 and 3, the carrier 2 includes a pair of straps 71, an abdomen contact plate 72, and two arms 73. The straps 71 are arcuate and shaped to fit on the shoulders of a drummer. The abdomen contact plate 72 comes into contact with the abdomen of the drummer so as to cover the abdomen. The arms 73 link the straps 71 and the abdomen contact plate 72. A connection member 74 connects the two arms 73 to each other at their generally middle part in the vertical direction. The top portions of the two arms 73 extend generally in the horizontal direction and are arranged along a substantially straight line.

As shown in FIGS. 3 and 5, a connection bracket 75 is attached to the front end of each strap 71 to connect the strap 71 to the top end portion of the arm 73. Each connection bracket 75 includes a pair of connection pieces, which sandwich the arm 73. A bolt 76 fastens the connection pieces in this state so that the connection bracket 75 is fixed to the arm 73 at any angle. As shown in FIG. 5, the bolt 76 extends through the connection bracket 75 and into the strap 71 to fix the connection bracket 75 to the strap 71. This connects the arm 73 and the strap 71 to each other.

The structure of the first connection mechanisms 3 and 4 for the carrier 2 will now be described. Referring to FIGS. 3 and 5, a groove 77, which opens toward the sides and the front and which extends laterally, is formed in a lower portion of each connection bracket 75. As shown in FIG. 5, the head 78*a* of a bolt 78 is inserted from the side into the groove 77 of each connection bracket 75. A threaded portion 78*b* of the bolt 78 projects frontward from the front opening of the groove 77. The bolt 78 is slidable along the groove 77. A nut 82 is fastened to the threaded portion 78*b* via washers 79 and 81. The nut 82 and the head 78*a* of the bolt 78 sandwich flanges 77*a* of the groove 77 so that the bolt 78 is fixed to the connection bracket 75. Further, the hook 83, which projects upward, is formed on the front end of the bolt 78.

To mount the bass drum 1 on the carrier 2, the hook receptacles 28, which function as drum-side receptacles portions of the first connection mechanisms 3 and 4, is hooked from above to the hooks 83, which function as carrier-side engagement portions, of the first connection mechanisms 3 and 4.

As shown in FIG. 3, the distance between the two arms 73 gradually increases from the position corresponding to the top end of the connection member 74 toward lower portions of the arms 73. The portions of the arms 73 facing towards the abdomen contact plate 72 extend vertically and are substantially parallel to each other. Brackets 84 and 85 for the arms 73 are attached to the abdomen contact plate 72 by screws (not shown). Each of the brackets 84 and 85 includes two connection pieces. The lower portion of each arm 73 is inserted in an opening formed between the corresponding pair of connection pieces. Bolts 86 and 87 respectively fasten the pairs of connection portions pieces. In this way, each arm 73 is sandwiched between the connection pieces of the corresponding one of the brackets 84 and 85. This connects the arms 73 to the abdomen contact plate 72.

The structure of the second connection mechanism 5 for the carrier 2 will now be described. In the abdomen contact plate 72, another bracket 88 having the same structure as the brackets 84 and 85 is attached at a position between the two brackets 84 and 85 by a screw (not shown). A slide member 89 is attached to the abdomen contact plate 72 by the bracket 88. The slide member 89 is a rod-like member arranged to extend in a generally vertical direction. The slide member 89 is inserted through an opening of the bracket 88. In this state, a bolt 91 fastens the slide member 89 to the abdomen contact plate 72. The bolt 91 is loosened so that the slide member 89 becomes slidable with respect to the bracket 88. Thus, the slide member 89 is movable relative to the carrier 2. Accordingly, the height of the slide member 89 may be adjusted when necessary.

As shown in FIGS. 3, 6, and 7, the carrier-side engagement member 92, which is engaged with the drum-side engagement member 55, is arranged on the distal end (upper end) of the slide member 89. FIGS. 9(*a*) to 9(*f*) show the carrier-side engagement member 92. FIG. 9(*a*) is a front view showing the carrier-side engagement member 92, FIG. 9(*b*) is a plan view showing the carrier-side engagement member 92, FIG. 9(*c*) is a left side view showing the carrier-side engagement member 92, FIG. 9(*d*) is a right side view showing the carrier-side engagement member 92, FIG. 9(*e*) is a cross-sectional view taken along line 9*e*-9*e* in FIG. 9(*a*), and FIG. 9(*f*) is a cross-sectional view taken along line 9*f*-9*f* in FIG. 9(*c*).

As shown in FIGS. 9(*c*), 9(*e*), and 9(*f*), the carrier-side engagement member 92 includes a main portion 93 and a mating portion 94. The main portion 93 has an insertion hole 95 that opens downward, in which the slide member 89 is inserted. The mating portion 94 is engaged with the mating portion 57 of the drum-side engagement member 55 shown in FIGS. 6 and 7.

As shown in FIG. 9(*b*), the mating portion 94 projects frontward from the main portion 93.

As shown in FIGS. 9(*c*) and 9(*d*), a semispherical recess 96 is formed in the right side surface of the mating portion 94, and a U-shaped notch 97 facing the recess 96 is formed in the left side surface of the mating portion 94. The width W of the notch 97 is slightly larger than the diameter of the semispherical projection 63 of the drum-side engagement member 55. When the connection member 42 and the slide member 89 are connected to each other, the projection 63 is fitted in the notch 97 at any angular position as shown in FIG. 7. The semispherical recess 96 is shaped to correspond to the shape of the distal end of the bolt 65.

The operation of the connecting structure of the bass drum 1 and the carrier 2 described above will now be described.

When the drummer uses the bass drum 1, the drummer wears the carrier 2 by positioning the pair of straps 71 of the carrier 2 over his or her shoulders and the abdomen contact plate 72 in contact with his or her abdomen.

Next, the drummer mounts the bass drum 1 on the carrier 2 by following the procedure described below. First, the drummer inserts the hooks 83, which are on the upper portions of the carrier 2, from underneath into the bores 30 of the hook receptacles 28 of the bass drum 1. In this state, the drummer lifts the carrier 2 so that the top ends of the hooks 83 are completely inserted in the bores 30. As a result, the bass drum 1 is hung on and held by the carrier 2. Although the bass drum 1 is held provisionally in this state, the weight of the bass drum 1 acts in a direction that securely engages the hooks 83 with the hook receptacles 28. Thus, the drummer has freedom to walk even at this stage since the hook receptacles 28 will not fall off the hooks 83. Further, the pivot portions 28*a* of the hook receptacles 28 permit the bass drum 1 to pivotally move around the axis of the pivot portions 28*a*, which is parallel with the axis of the bass drum 1 (line connecting the centers of the heads 7 and 8). Thus, the position of the bass drum 1 with respect to the drummer is adjustable while the surfaces of the heads 7 and 8 of the bass drum 1 are held in a vertical state. This enables the drummer to adjust the bass drum 1 to a favorable playing position before fixing the bass drum 1 to the second connection mechanism 5.

Next, the drummer moves the bottom end of the connection member 42 arranged on the bass drum 1 toward the top end of the slide member 89 arranged on the carrier 2. The drummer engages the drum-side engagement member 55, which is arranged on the bottom end of the connection member 42, with the carrier-side engagement member 92, which is arranged on the top end of the slide member 89.

The drummer in advance adjusts the fastening amount of the bolt 47 and the nut 52 before mounting the bass drum 1 to apply a suitable pivot resistance to the connection member 42. Thus, the drummer may adjust the screw amount of the bolt 47 and the nut 52 so that the connection member 42 is pivotal and may be held at any angle when the drummer releases his or her hand from the connection member 42 at a selected angle. This facilitates the connection of the drum-side engagement member 55 to the carrier-side engagement member 92. It is preferable that the connection member 42 be positioned closer to the drummer when the drummer mounts a bass drum 1 with a large diameter, like the bass drum 1*c* shown in FIG. 10. This would enable the drummer to easily hold the connection member 42 and facilitate the mounting of the bass drum 1*c*.

When the drum-side engagement member 55 is engaged with the carrier-side engagement member 92, the mating portion 94 of the carrier-side engagement member 92 is fitted in the insertion portion 62 of the drum-side engagement member 55, and the semispherical projection 63 of the drum-side engagement member 55 is fitted in the notch 97 of the carrier-side engagement member 92.

In this state, the projection 63 is fitted to the notch 97. Thus, the bass drum 1 remains in this state unless the bass drum 1 vibrations vertically move the bass drum 1. In other words, the bass drum 1 is provisionally supported in this state to enable the vertical position of the bass drum 1 to be adjusted. In this state, the drum-side engagement member 55 of the connection member 42 and the carrier-side engagement member 92 of the slide member 89 can easily be disengaged from each other. Further, in this state, the distal end of the bolt 65 extending through the right projection 59 of the drum-side engagement member 55 faces the recess 96 of the carrier-side engagement member 92.

Next, the drummer tightens the bolt 65 shown in FIG. 7 so that the distal end of the bolt 65 enters the recess 96. When the distal end of the bolt 65 is fitted in the recess 96, the drum-side engagement member 55 of the connection member 42 and the carrier-side engagement member 92 of the slide member 89, which are engaged with each other, cannot be separated from each other. In this state, the engaging drum-side engagement member 55 and the carrier-side engagement member 92 are pivotal relative to each other as long as the distal end of the bolt 65 is not pressed against the recess 96.

In this way, the bass drum 1 is mounted on the carrier 2 and the vertical position of the mounted bass drum 1 is adjusted. When the bolt 91 of the bracket 88 shown in FIG. 3 is loosened, adjustment of the vertical position of the bass drum 1 vertically moves the slide member 89 via the connection member 42. In this state, the drummer may adjust the position of the top end of the bass drum 1 to any position. Then, the drummer tightens the bolt 91 to fix the slide member 89. In this way, the bass drum 1 may be fixed at a desired position.

The drummer may in advance roughly adjust the height of the slide member 89 before mounting the bass drum 1 on the carrier 2. In this case, after mounting the bass drum 1, the drummer is only required to finely adjust the height of the slide member 89 while checking the position of the mounted bass drum 1. This facilitates adjustment of the position of the bass drum 1.

When the drum-side engagement member 55 of the connection member 42 and the carrier-side engagement member 92 of the slide member 89 are pivotally engaged with each other, the engaged portion of the drum-side engagement member 55 and carrier-side engagement member 92 forms a three-bar linkage mechanism together with the first connection mechanisms 3 and 4 and the second connection mechanism 5. The hook receptacles 28 function as sliders that use the hooks 83 as a guide. In this case, the hook receptacles 28 are movable. Thus, the hook receptacles 28 may be disengaged from the hooks 83 when a large force is applied to the bass drum 1.

For the carrier 2 to securely hold the bass drum 1, the bolt 65 shown in FIG. 7 must be tightly fastened to fix the drum-side engagement member 55 to the carrier-side engagement member 92. In this state, the distal end of the bolt 65 is pressed against the recess 96. As a result, the distal end of the bolt 65 and the inner surface of the left projection 58 press the mating portion 94 from the left and right sides of the mating portion 94. This restricts pivotal movement of the engaged drum-side engagement member 55 and carrier-side engagement member 92 and restricts pivotal movement of the connection member 42 and the slide member 89 relative to each other. As a result, the bass drum 1 and the carrier 2 are securely fixed to each other. In this state, the drummer may of course march but may also move energetically such as to jolt the bass drum 1 without the bass drum 1 being separated from the carrier 2.

To remove the bass drum 1 from the carrier 2 after performance, the drummer follows the procedures opposite to the mounting procedure of the bass drum 1. First, the drummer loosens the bolt 65 and disengages the drum-side engagement member 55 of the connection member 42 from the carrier-side engagement member 92 of the slide member 89. This releases the engagement of the second connection mechanism 5. Next, the drummer lifts the bass drum 1 or places the bass drum 1 on a table or the like and lowers the carrier 2. The hooks 83 of the carrier 2 are separated from the hook receptacles 28 of the bass drum 1. This releases the engagements of the first connection mechanisms 3 and 4. The disconnected connection member 42 may be folded along the outer circumference of the bass drum 1 so that it does not interfere with storage of the bass drum 1.

Once the height of the slide member 89 is adjusted, the height of the slide member 89 does not need to be re-adjusted when the same bass drum 1 is used again.

The first embodiment has the advantages described below.

(1) In the first embodiment, the first connection mechanisms 3 and 4 arranged at two locations and the second connection mechanism 5 arranged at one location form three connection portions of the connection structure of the bass drum 1 and the carrier 2. The second connection mechanism restricts the movement of the bass drum 1 when the bass drum 1 is held by the two first connection mechanisms. As a result, the bass drum 1 is fixed to the carrier 2. Even if the drummer wearing the carrier 2 holding the bass drum 1 moves energetically, the connection structure of the bass drum 1 and the carrier 2 prevents the bass drum 1 from moving upward away from the carrier 2 and also prevents the bass drum 1 from generating noise.

(2) The bass drum 1 is easily held provisionally by the first connection mechanisms 3 and 4. Then, the bass drum 1 is also easily held provisionally by the second connection mechanism 5. Afterwards, a simple operation enables the bass drum 1 to be completely fixed to the carrier 2. In this way, the bass drum 1 is easily mounted on the carrier 2.

The first connection mechanisms 3 and 4 are positioned above the second connection mechanism 5. Thus, when the bass drum 1 is provisionally held, the bass drum 1 is held in a relatively stable manner only by the first connection mechanisms 3 and 4. With the bass drum 1 being held only by the first connection mechanisms 3 and 4, the position of the bass drum 1 with respect to the drummer may be checked. Alternatively, the bass drum 1 may be transported.

Further, the slide member 89 of the second connection mechanism 5 may be provisionally fastened. In this case, the bass drum 1 may be accurately fixed after the vertical position of the bass drum 1 is checked.

(3) The bass drum 1 is easily removed from the carrier 2 step by step by sequentially operating the second connection mechanism 5 and the first connection mechanisms 3 and 4.

Figure 14:
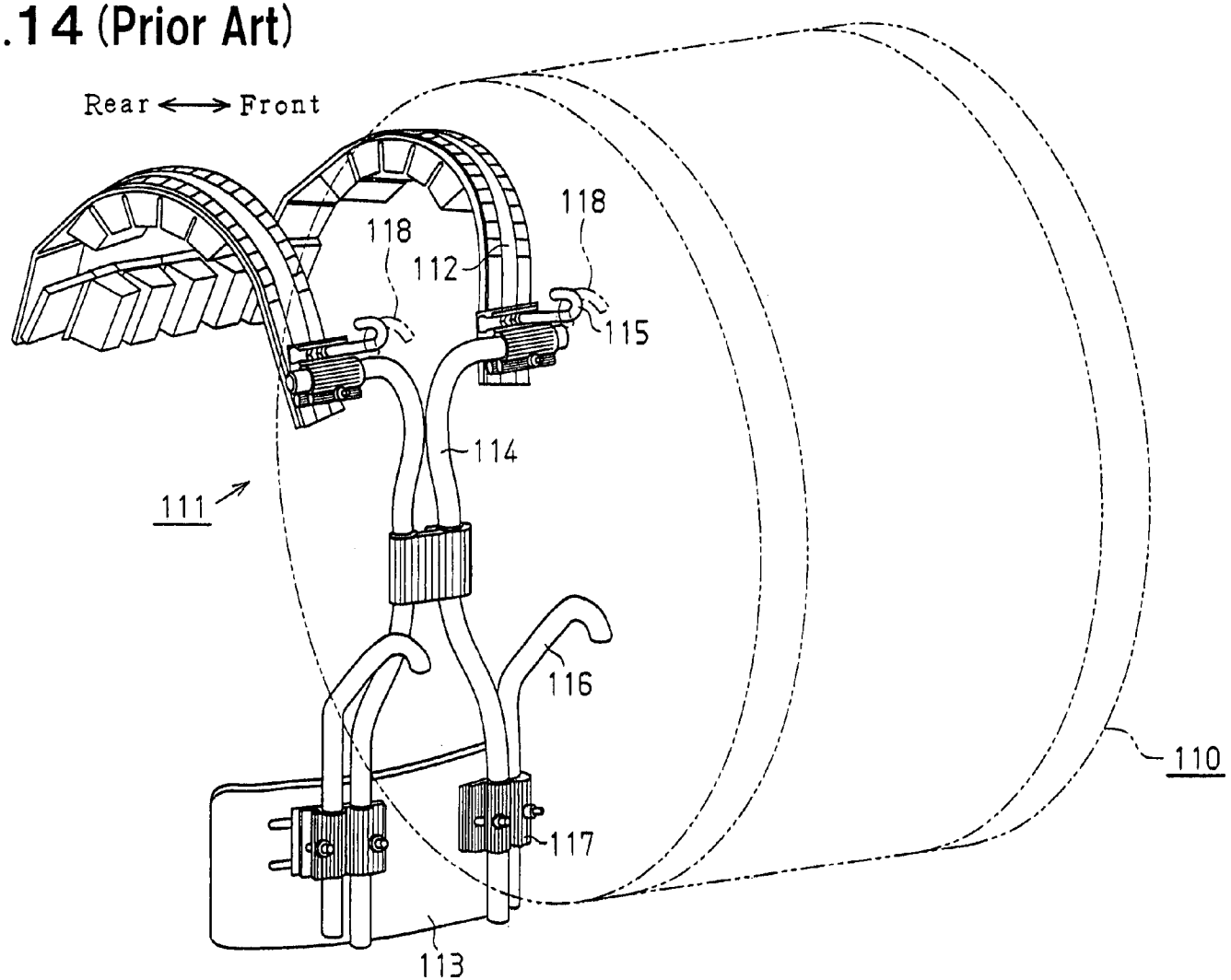
Fig.14 (Prior Art)
FIG. 14 is a perspective view showing a prior art marching bass drum in a state mounted on a conventional carrier.

(4) The second connection mechanism 5 is arranged at one position, and uses a single slide member 89 instead of using two rods as in the prior art example shown in FIG. 14. Thus, the bass drum 1 does not become inclined by displacement of the two rods 116, and the bass drum 1 is held in a stable manner.

(5) In the first embodiment, the bass drum 1 is pivotal about the bolts 34 of the first connection mechanisms 3 and 4 while the bass drum 1 is being supported by the first connection mechanisms 3 and 4. In this state, the pivotal movement of the bass drum 1 causes the slide member 89 to move vertically via the connection member 42. Thus, by loosening the bolt 91, the drummer may have to adjust the bass drum 1 to a desired position, that is, align the top end of the bass drum 1 with the eyes of the drummer, while checking the vertical position of the bass drum 1. In this way, the bass drum 1 is easily fixed at a desirable position by the drummer.

(6) The drum-side engagement member 55 of the connection member 42 and the carrier-side engagement member 92 of the slide member 89 are adjustable in a state in which these members are either provisionally fastened to each other or engaged with each other in a pivotal manner. Further, the drum-side engagement member 55 and the carrier-side engagement member 92 are adjustable in a wide range in a stepless manner. Thus, the bass drum 1 may be arranged at a desirable position by the drummer. Then, during performance, the bass drum 1 is securely fixed to the carrier 2 by tightening the bolt 65 to restrict the connection member 42 from pivoting relative to the slide member 89.

To adjust the position of the bass drum 1, the position of the slide member 89 may be adjusted before the bass drum 1 is mounted. Alternatively, the position of the slide member 89 may be adjusted after the bass drum 1 is mounted.

(7) Once the height of the bass drum 1 is adjusted, the vertical position of the bass drum 1 does not need to be adjusted again when the bass drum 1, which is removed from the carrier 2, is mounted on the carrier 2 again.

(8) The connection member 42 is arranged on the bass drum 1. Thus, when the mounted bass drum 1 is removed and another bass drum 1 with a different outer diameter is mounted, the vertical position of the other bass drum 1 may easily be adjusted to a desired position using the connection member 42 arranged on the other bass drum 1.

Second Embodiment

A second embodiment of the present invention will now be described with reference to FIGS. 11 to 13. In the present embodiment, like or same reference numerals are given to those components that are the same as the corresponding components of the first embodiment. The present embodiment will be described focusing on points differing from the first embodiment. The present embodiment is the same as the first embodiment in that a bass drum 1 is mounted on a carrier 2 by connection mechanisms arranged at a total of three locations, that is, first connection mechanisms 3 and 4 arranged at two locations and a second connection mechanism 5 arranged at one location. The structures of the first and second connection mechanisms differ from the corresponding structures in the first embodiment.

Figure 11:
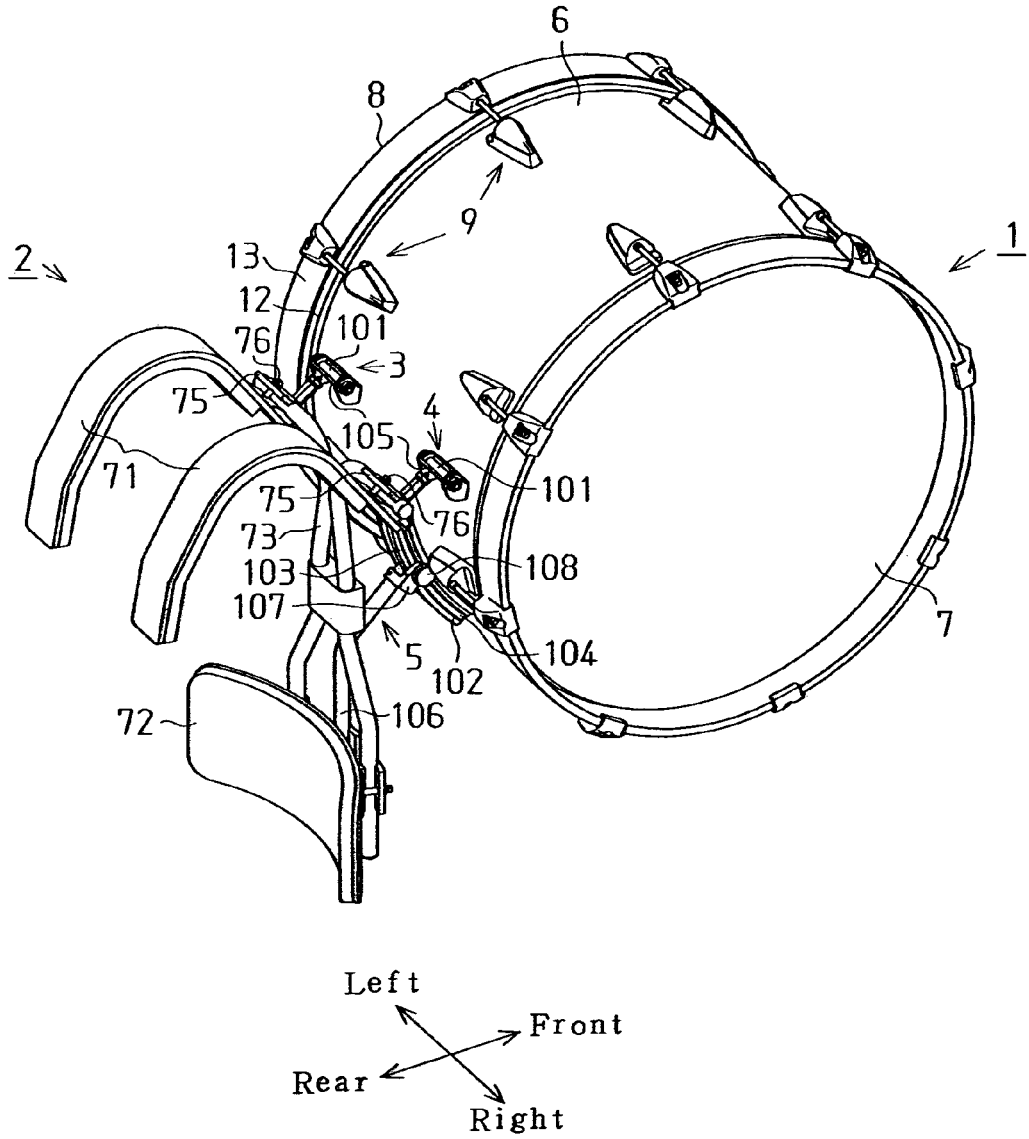
FIG. 11 is a perspective view showing a marching bass drum in a state mounted on a carrier according to a second embodiment of the present invention.

FIG. 11 shows the supporting structure of the marching bass drum 1 according to the present embodiment in a state in which the marching bass drum 1 is mounted on the carrier 2. FIG. 12 shows the second connection mechanism 5 of FIG. 11.

As shown in FIG. 11, two engagement shafts 101, which form the first connection mechanisms 3 and 4, are arranged on the outer surface of the shell 6 of the bass drum 1. A rail member 102, which forms the second connection mechanism 5, is arranged on the shell 6 below and between the two engagement shafts 101. The rail member 102 is arcuate and extends along the outer surface of the shell 6. As shown in FIG. 12, a groove 103 is formed in the middle of the rail member 102. Further, an engagement groove 104 is formed in the right side surface of the rail member 102. A bolt 108, which is arranged on the carrier 2, is fitted in the engagement groove 104.

Two hooks 105, which form the first connection mechanisms 3 and 4, are arranged on the carrier 2. The hooks 105 correspond to the hooks 83 of the first embodiment. Each hook 105 is U-shaped and formed by bending a plate member to open upward. The engagement shafts 101 are engaged with the hooks 105 so that the bass drum 1 is connected to the carrier 2.

A slide member 106 is attached to an abdomen contact plate 72. The slide member 106 is adjustable in the vertical direction in the same manner as in the first embodiment. The slide member 106 in the second embodiment is bent at its generally middle portion so that its distal portion projects diagonally frontward.

Figure 12:
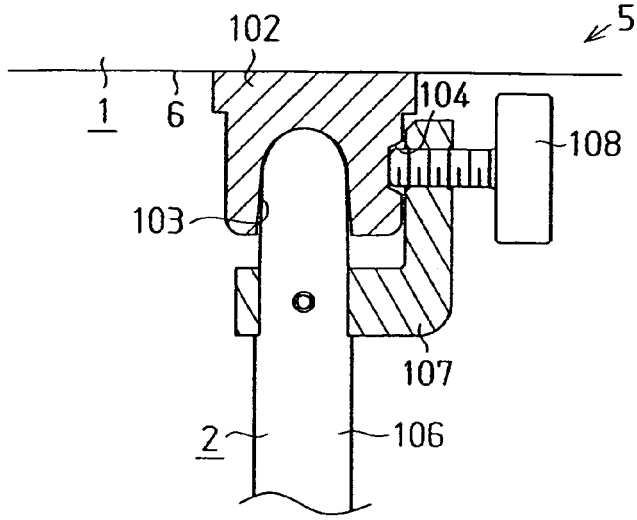
FIG. 12 is a partial cross-sectional view showing a second connection mechanism in the second embodiment.
Figure 13:
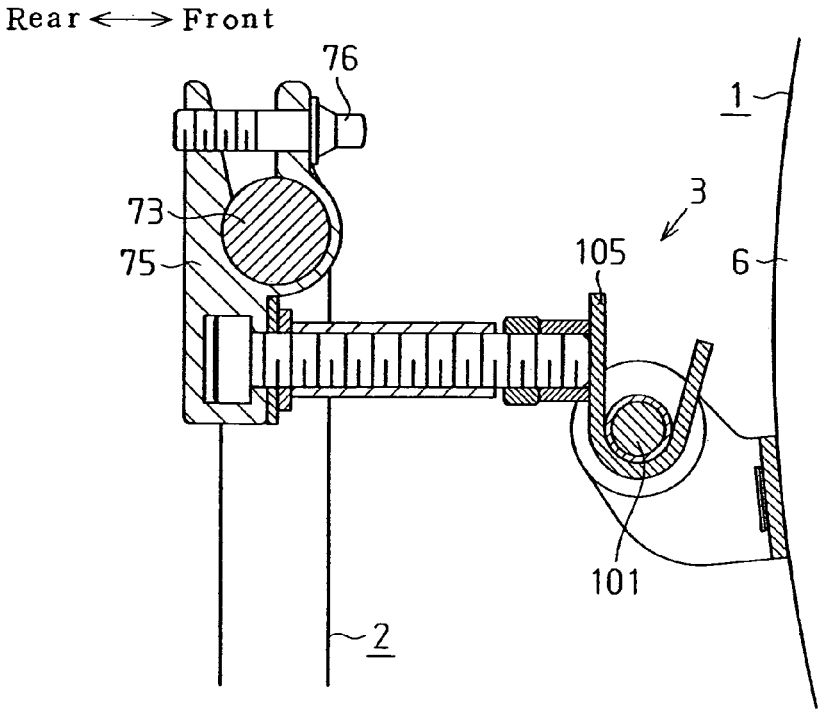
FIG. 13 is a partial cross-sectional view showing a first connection mechanism in the second embodiment.

As shown in FIG. 12, an L-shaped connection fitting 107 is attached to the distal portion of the slide member 106. A bolt 108 is fastened to the right side of the connection fitting 107. The distal end of the slide member 106 is fitted in the groove 103 of the above rail member 102. The distal end of the bolt 108 is fitted in the engagement groove 104, which is formed in the side surface of the rail member 102.

In the above structure, when the bass drum 1 is mounted on the carrier 2, the distal end of the slide member 106 is fitted in the groove 103 of the rail member 102. Then, the bolt 108 is screwed so that the distal end of the bolt 108 comes into contact with the bottom surface of the engagement groove 104. The distal end of the bolt 108 and the outer surface of the slide member 106 presses the rail member 102. As a result, the bass drum 1 and the carrier 2 are securely connected to each other. Further, the slide member 106 and the connection fitting 107 become movable along the rail member 102 by loosening the bolt 108 without having the bolt 108 fall off from the engagement groove 104. When the bolt 108 is loosened, the slide member 106 may be vertically moved with respect to the carrier 2 so that the distal end of the slide member 106 moves on the rail member 102. This changes the position at which the slide member 106 is connected to the rail member 102. The vertical position of the bass drum 1 may be varied in a continuous manner by changing the position at which the slide member 106 is connected to the rail member 102.

The second embodiment has the same advantages as advantages (1) and (6) of the first embodiment.

It should be apparent to those skilled in the art that the present invention may be embodied in many other specific forms without departing from the spirit or scope of the invention. Particularly, it should be understood that the present invention may be embodied in the following forms.

In the first embodiment, a plurality of connection members 42 that differ in length according to the size of the bass drums 1*a*, 1*b*, and 1*c* may be used as shown in FIG. 10. The use of connection members 42*a*, 42*b*, and 42*c* that differ in length enables the top end of the bass drum 1 to be aligned with the eyes of the drummer in accordance with the height of the drummer.

Further, the connection member 42 may be telescopic so that its length can be changed. In this case, the vertical position of the bass drum 1 can be adjusted within a wide range by appropriately changing the length of the connection member 42. More specifically, in addition to the angle adjustment of the connection member 42 with respect to the bass drum 1, the vertical position of the bass drum 1 may be adjusted by changing the position of the distal end of the connection member 42. This enlarges the adjustment range.

The connection member 42 may be curved in an arcuate manner in correspondence with the outer surface of the bass drum 1. The connection member 42 extending from the bass drum 1 may be pivoted so that it lies along the outer surface of the bass drum 1 to enable compact storage of the bass drum 1 and the connection member 42.

In the first embodiment, the hooks 83 are arranged on the carrier 2 and the hook receptacles 28 are arranged on the bass drum 1. However, hook receptacles 28 that open upward may be arranged on the carrier 2 and hooks 83 extending downward may be arranged on the bass drum 1.

In the first embodiment, the drum-side engagement member 55 is arranged on the bass drum 1 and the carrier-side engagement member 92 is arranged on the carrier 2. However, the engagement member 55 may be arranged on the carrier 2 and the engagement member 92 may be arranged on the bass drum 1.

In the first embodiment, the connection member 42 may be removable from the bass drum 1 and pivotal when attached to the bass drum 1. In this case, the connection member 42 and the slide member 89 may be connected so that they are not separable from each other but pivotal relative to each other.

The slide member 89 may be eliminated, and the carrier 2 may have a plurality of carrier-side engagement members 92 arranged at different heights on the carrier 2.

In the second embodiment, the rail member 102 may be eliminated from the second connection mechanism 5. Instead, the second connection mechanism 5 may have a plurality of engagement members that are engaged with the distal end of the slide member 106 and arranged at different positions.

In the first embodiment, the first connection mechanisms 3 and 4 may be replaced by the first connection mechanisms 3 and 4 of the second embodiment without changing the structure of the second connection mechanism 5. Alternatively, in the second embodiment, the first connection mechanisms 3 and 4 may be replaced by the first connection mechanisms 3 and 4 of the first embodiment.

In the second embodiment, the first connection mechanisms 3 and 4 may be replaced by connection mechanisms using the hooks of the prior art (refer to FIG. 14) without changing the structure of the second connection mechanism 5. This would also stably fix the bass drum 1 with the second connection mechanism 5.

Although the second connection mechanism 5 is arranged at a single location in the above embodiments, the second connection mechanism 5 may be arranged at more than one location.

The present examples and embodiments are to be considered as illustrative and not restrictive, and the invention is not to be limited to the details given herein, but may be modified within the scope and equivalence of the appended claims.

What is claimed is:

1. A supporting structure for supporting a marching bass drum on a carrier worn by a drummer such that drum heads of the marching bass drum are held vertically, the supporting structure comprising:

a first connection mechanism including a hooking portion positioned on the carrier, a hooked portion positioned on the marching bass drum, and a first pivot having a first axis parallel to an axis of the marching bass drum, the hooking portion and the hooked portion being hooked to movably connect the marching bass drum to the carrier; and a second connection mechanism extending a length from the marching bass drum to the carrier and restricting movement of the marching bass drum relative to the carrier when the first connection mechanism pivotally connects the marching bass drum to the carrier, the second connection mechanism comprising a connection member including a first end connected to the marching bass drum, a second end connected to the carrier and a second pivot having a second axis parallel to the axis of the marching bass drum, wherein the first connection mechanism supports the marching bass drum such that the marching bass drum is pivotal about the first axis when the marching bass drum is connected to the carrier, and wherein the first end of the connection member of the second connection mechanism is pivotal about the second axis to adjust a position of the first end with respect to the carrier depending on an outer diameter of the marching bass drum.

2. The supporting structure according to claim 1, wherein the supporting structure includes two first connection mechanisms and one second connection mechanism, and the two first connection mechanisms are positioned above the one second connection mechanism when the marching bass drum is supported on the carrier and worn by the drummer.

3. The supporting structure according to claim 1, wherein the connection member includes a third pivot having a third axis parallel to the axis of the marching bass drum and wherein the second end of the connection member is pivotal about the third axis.

4. The supporting structure according to claim 3, wherein the second connection mechanism includes a slide member arranged in a manner that its position is adjustable relative to the carrier, in which the slide member is for connecting the connection member to the carrier.

5. The supporting structure according to claim 4, wherein the connection member is connected to the marching bass drum in a manner pivotal about said another axis parallel to the axis of the marching bass drum.

6. The supporting structure according to claim 4, wherein the slide member and the connection member are connected to each other in a separable manner.

7. The supporting structure according to claim 1, wherein one of the hooking portion arranged on the carrier and the hooked portion arranged on the marching bass drum includes a rod, and the other one of the hooking portion arranged on the carrier and the hooked portion arranged on the marching bass drum includes a rod receptacle into which the rod is inserted.

8. The supporting structure according to claim 7, wherein the hooking portion arranged on the carrier includes the rod and the hooked portion arranged on the marching bass drum includes the rod receptacle, the rod receptacle having a bore for receiving the rod.

9. The supporting structure according to claim 1, wherein the connection member comprises a telescopic body.

10. A carrier having the supporting structure according to claim 1.

11. A marching bass drum having the carrier according to claim 9.

* * * * *